US005868152A

United States Patent [19]

Brown

[11] Patent Number: 5,868,152

[45] Date of Patent: Feb. 9, 1999

[54] ROTATING PATIO UMBRELLA FAN

[76] Inventor: Robert Campbell Brown, 136 Edgewater Dr., Gilford, N.H. 03246

[21] Appl. No.: 13,105

[22] Filed: Jan. 26, 1998

[51] Int. Cl.[6] ..... A45B 25/00

[52] U.S. Cl. ..... 135/31; 135/33.2; 135/19; 416/132 A

[58] Field of Search ..... 135/20.3, 16, 15.1, 135/33.2, 33.41, 31, 19; 416/132 A, 196 R, 142, 169 R

[56] References Cited

U.S. PATENT DOCUMENTS

| | | | |
|---|---|---|---|
| 1,148,332 | 7/1915 | Onyskow . | |
| 1,387,740 | 8/1921 | Stevens . | |
| 1,532,802 | 4/1925 | Feistner . | |
| 1,619,217 | 3/1927 | Reid . | |
| 2,729,220 | 1/1956 | Smyrnow . | |
| 3,861,410 | 1/1975 | Cognet . | |
| 5,007,811 | 4/1991 | Hopkins | 135/16 |
| 5,020,557 | 6/1991 | Apple | 135/15.1 |
| 5,172,711 | 12/1992 | Mueller | 135/20.3 |
| 5,349,975 | 9/1994 | Valdner | 135/16 |
| 5,449,012 | 9/1995 | Friedman . | |
| 5,765,582 | 6/1998 | Molnar, IV . | |

FOREIGN PATENT DOCUMENTS

| | | | |
|---|---|---|---|
| 1388057 | 12/1964 | France | 135/33.2 |
| 0003091 | 6/1887 | United Kingdom | 135/33.2 |

*Primary Examiner*—Lanna Mai

[57] ABSTRACT

A rotating umbrella includes a canopy which serves a fan. The umbrella canopy is formed by a plurality of segmented petals extending radially outwardly in a fan-like fashion, and connected to a hub mounted on a shaft. The shaft includes a drive shaft member coupled to a second shaft member which connected to the hub at its upper end, wherein the drive shaft member is powered by a motor such that it rotates and operatively engages the second shaft member to rotate the hub and the petals of the canopy. The motor and the drive shaft both mounted on a base plate on the ground to stabilize the umbrella. A cooling breeze is produced when the petals are rotated to deter flying insects and to shield a person setting beneath the umbrella from the elements.

8 Claims, 8 Drawing Sheets

ROTATING PATIO UMBRELLA FAN

BACKGROUND OF THE INVENTION

I. Field of the Invention

The instant invention relates to umbrellas and outdoor canopies in combination with fans. Particularly, the present invention relates to umbrellas and outdoor canopies in combination with fans that are combined in a single unit to provide relief from the sun and to provide a cooling air flow to one setting beneath the umbrella or canopy. More particularly, the present invention relates to an umbrella that has a canopy consisting of segmented petals that are rotated about a shaft producing a cooling air flow. More particularly, the present invention relates to an umbrella wherein the canopy is comprised of segmented petals that are driven by a motor that rotates a shaft that is connected to the segmented petals and rotates these segmented petals producing a cooling air flow.

II. Description of the Related Art

Numerous umbrellas have been provided in the prior art that consist of an umbrella that is connected to a fan. For example, U.S. Pat. No. 5,349,975 (1994) issued to Valdner teaches a small fan under the canopy of an umbrella that served to exchange the hot air under the canopy with cool air. U.S. Pat. No. 5,172,711 issued to Mueller in 1992 teaches a small fan mounted beneath the canopy to provide a cooling breeze to those underneath the canopy, and U.S. Pat. No. 5,007,811 (1991) to Hopkins teaches a ceiling type fan mounted underneath a canopy, for providing a cooling breeze to those underneath it. In each of these devices, the fan was treated as an accessory to an already existing umbrella. Other umbrellas or canopies such as U.S. Pat. No. 5,020,557 to Apple (1991) attempted to reduce the forces applied to canopy umbrellas by allowing the canopy to rotate freely in the wind. The present invention provides several advantages over the prior art. One advantage in contrast to other devices, is that the present invention incorporates rotating a canopy comprised of segmented petals to produce air flow. This air flow acts to push stale hot air from underneath the canopy or umbrella as well as provide a cooling breeze. A further advantage is given by the operation of the segmented petals in reverse which acts to draw the stale hot air from underneath the canopy and force it out the top. A further advantage is given in that by rotating the umbrella canopy to produce the breeze, the number of parts needed to manufacture the invention is reduced. Another advantage is that by using the segmented petals as the blades of a fan, there is nothing additional to add to or mount on the umbrella. A further advantage is that the larger surface area that is being rotated contributes to the production of more air flow per rotation. Another advantage is that by having more air flow produced by the larger surface area, the invention is more efficient in comparison to a smaller fan which would have to make many more revolutions to produce a similar air flow volume. Another advantage is that by having an air flow present, the present invention has the direct effect of deterring flying insects that act as an irritant to people sitting under the canopy. The present invention is also weather resistant and can be left outdoors. The segmented petals of the present invention provide another advantage over the prior art in that wind loading is reduced on the invention as a whole by allowing for some air flow between the petals themselves. This reduced wind loading results in the advantage of being more resistant to tipping due to wind forces. This advantage is accentuated by the presence of the base plate which acts as a weighted anchor for the present invention. A further advantage is that the present invention does not necessarily have to have electrical current present to power the rotating canopy's petals, in a preferred embodiment, the power for rotation is supplied by solar panels. In another preferred embodiment, the power for rotation is supplied by a foot crank which can be used to wind up a mechanism to rotate the canopy's drive shaft.

SUMMARY OF THE INVENTION

What is needed is a device that provides a fewer number of parts for manufacture. What is further needed is a device that has a large surface area to rotate resulting in a more efficient production of air flow and that provides significant air flow with fewer revolutions. What is still further needed is a device that can withstand wind forces without tipping. A further need is for a device that does not need to have anything added to it to produce an air flow. What is still further needed is a device that has a fewer number of parts to assemble before working.

The present invention provides benefits of both umbrellas and fans by combining aspects of both to produce a rotating umbrella that acts as a fan. The portion of the umbrella that acts to protect one from the elements such as the sun are segmented, overlapping, drooping petals that are rotated in a fan-like fashion to produce the air flow. This air flow benefits those beneath the petals in that a cooling breeze is produced and this breeze also acts a deterrent to flying insects. By rotating the full diameter of the umbrella a large area (greater than the diameter of the umbrella) is cooled. Due to the umbrella top being segmented into drooping petals, it is less vulnerable to tipping or damage from wind loading because of its allowance for some blow-through. The petals are rotated by a drive shaft located inside the pole of the umbrella. The drive shaft is driven by a motor that can be powered by electricity or other means. In a preferred embodiment, the invention is equipped with a variable speed control to provide varying amounts of air flow. The variable speed control can also control the direction of rotation of the petals such that by operating in the forward mode, a breeze is pushed down and by operating in the reverse mode, air is drawn out from beneath the canopy. By having electrical power being generated or present, the invention also embodies a ground fault interrupter (GFI) with duplex electrical outlets. These duplex electrical outlets lend the additional benefit of providing a power source to a radio, television, blender or any other household appliance that may contribute to the user's overall enjoyment of the outdoors. In a preferred embodiment, the electricity is provided through solar panels that can be located on or near the petals. The motor also acts as a weight to help provide stability and sits upon a base plate to which the drive shaft is also attached. This base plate provides the foundation for the present invention. To help protect the present invention from the elements, weather shield washers are provided that shield the internal parts of the present invention. This dual use of the petals as blades of a fan and shelter from the elements is relatively inexpensive, easy to produce and use, durable, and is efficient in it's production of an air flow.

DESCRIPTION OF THE PREFERRED EMBODIMENTS

Figure 1:
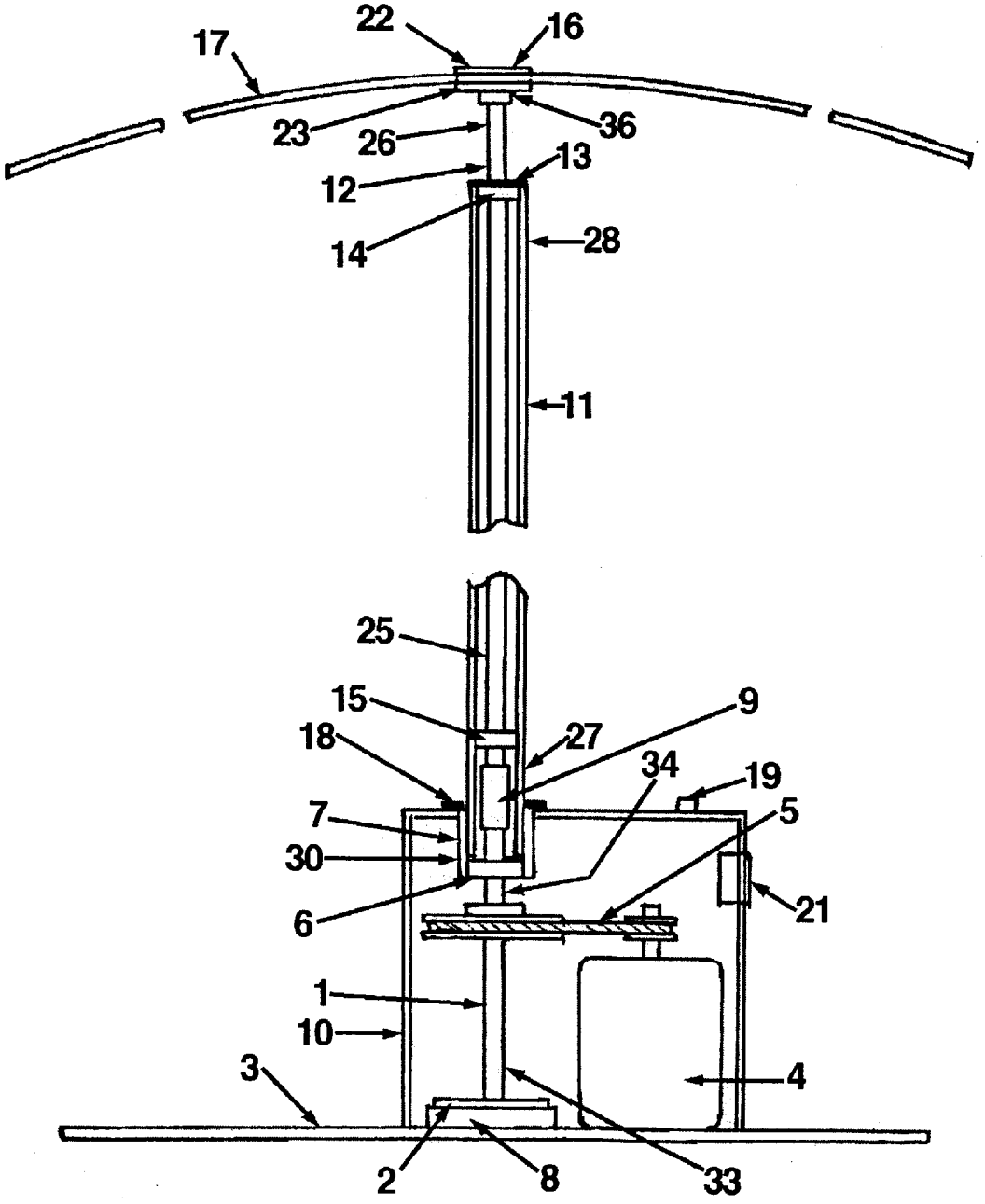
FIG. 1 is a side view cross section showing two petals, the hub, the hub connector, the control switch grand fault interrupter duplex electrical outlet, the drive mechanism and the housing for the motor as well as the base plate.

FIG. 1 shows a drive shaft 1 supported by a thrust bearing 2 at the proximal end of the drive shaft 33 which secures the drive shaft 1. The thrust bearing 2 is inside the thrust bearing housing 8 which is attached to the base plate 3. This base plate 3 also serves as an anchor for the device as a whole. A motor 4 is attached to the base plate 3 and powers the drive mechanism 5 which engages the drive shaft 1 such that the drive shaft 1 rotates. A drive shaft bearing 6 enclosed by the drive shaft bearing housing 7 supports the distal end of the drive shaft 34. The main housing 10 sits on the base plate 3 and encloses the motor 4, thrust bearing 2, drive shaft 1, drive mechanism 5 and the proximal end of the removable stationary shaft 27. A slide coupling 9 as shown in FIG. 1 and in detail in FIG. 2 allows the distal end of the drive shaft 34 to engage the secondary shaft 12. The secondary shaft 12 comprises a proximal end of the secondary shaft 25, the secondary shaft 12, and the distal end of the secondary shaft 26. FIG. 1 also shows the drive shaft bearing housing 7 and removable stationary shaft receiver 30. The sides of the removable stationary shaft receiver 30 act as the sides of the drive shaft bearing housing 7. The removable stationary shaft receiver 30 supports and secures the removable stationary shaft 11 at the proximal end of the removable stationary shaft 28. The removable stationary shaft 11 encloses the distal end of the drive shaft 34, the drive shaft bearing 6, the secondary shaft 12, the slide coupling 9, the proximal bearing 15, and the distal bearing 14. The proximal bearing 15 supports the proximal end of the secondary shaft 25 just above the slide coupling 9. The distal bearing 14 supports the distal end of the secondary shaft 26. The larger weather shield washer 18 sits atop the main housing 10 protecting the drive shaft bearing housing 7 and removable stationary shaft receiver 30 from the elements. The larger weather shield washer 18 also protects the interior components of the main housing 10 form the elements. The smaller weather shield washer 13 is atop the removable stationary shaft 11 just above the distal bearing 14 where it protects the secondary shaft 12, the proximal bearing 15, the distal bearing 14, the slide coupling 9, the drive shaft bearing 6, and the interior components of the main housing 10 from the elements. A hub 16 is located at the distal end of the secondary shaft 26. The hub has a hub top 22, a hub bottom 23, and a hub connector 36. The petals 17 are attached to and radiate outward from the hub 16. The motor 4 is operated by a variable speed control switch 19. When the variable speed control switch 19 is activated, the motor 4 engages the drive mechanism 5 that in turn rotates the drive shaft 1 which is operatively engaged to the secondary shaft 12. The variable speed control switch 19 also controls the motor 4 speed and direction of rotation of the drive shaft 1. A ground fault interrupter duplex electrical outlet 21 is on the main housing 10 and can be used to provide electric power to other appliances or entertainment components.

Figure 2:
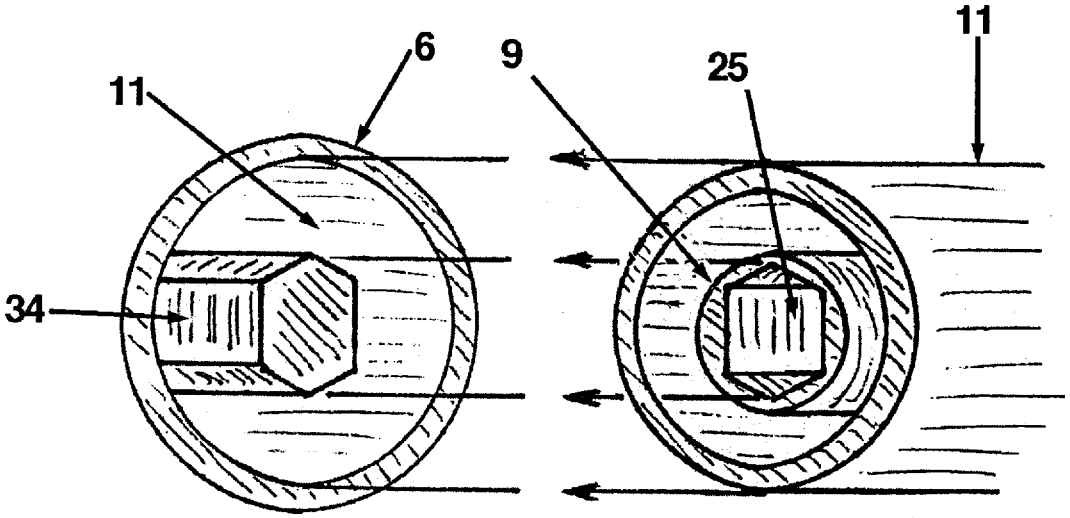
FIG. 2 is an internal view of how the slide coupling operates to allow the drive shaft to operatively engage the secondary shaft.

FIG. 2 illustrates in detail the operation of the slide coupling 9 where the distal end of the drive shaft 34 engages the proximal end of the secondary shaft 25 that is surrounded by the slide coupling 9 and enclosed by the removable stationary shaft 11.

Figure 3:
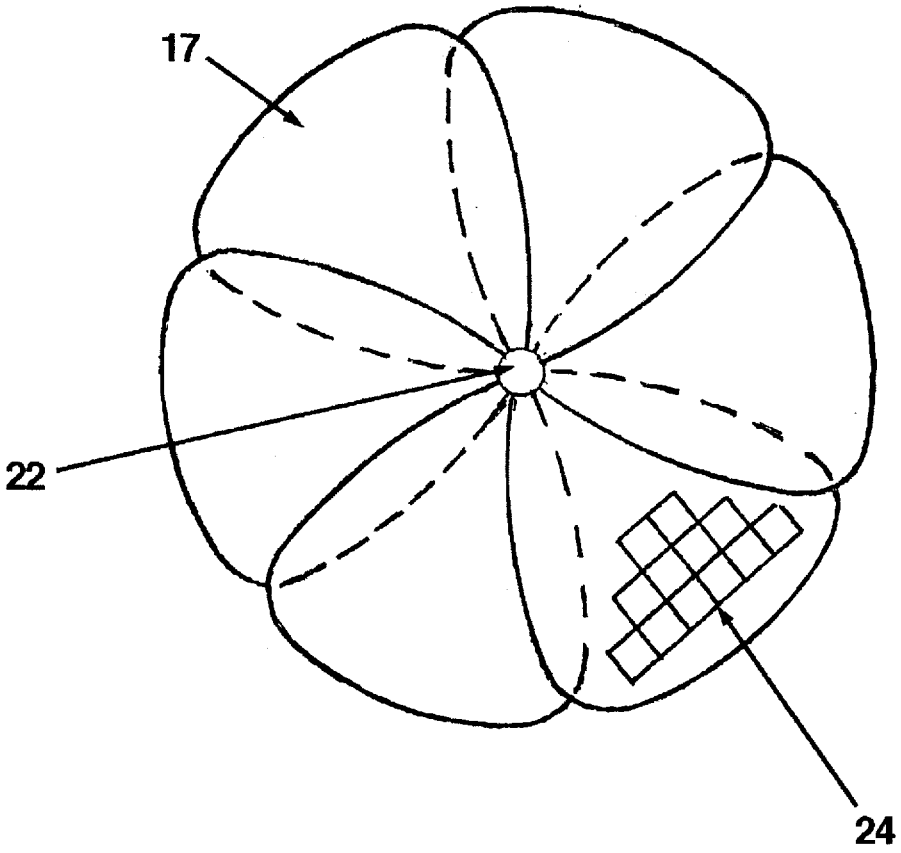
FIG. 3 is an overhead view of how the petals overlap and radiate from the hub. Additionally, it shows how the solar panels may be placed on the petals for a preferred embodiment.
Figure 4:
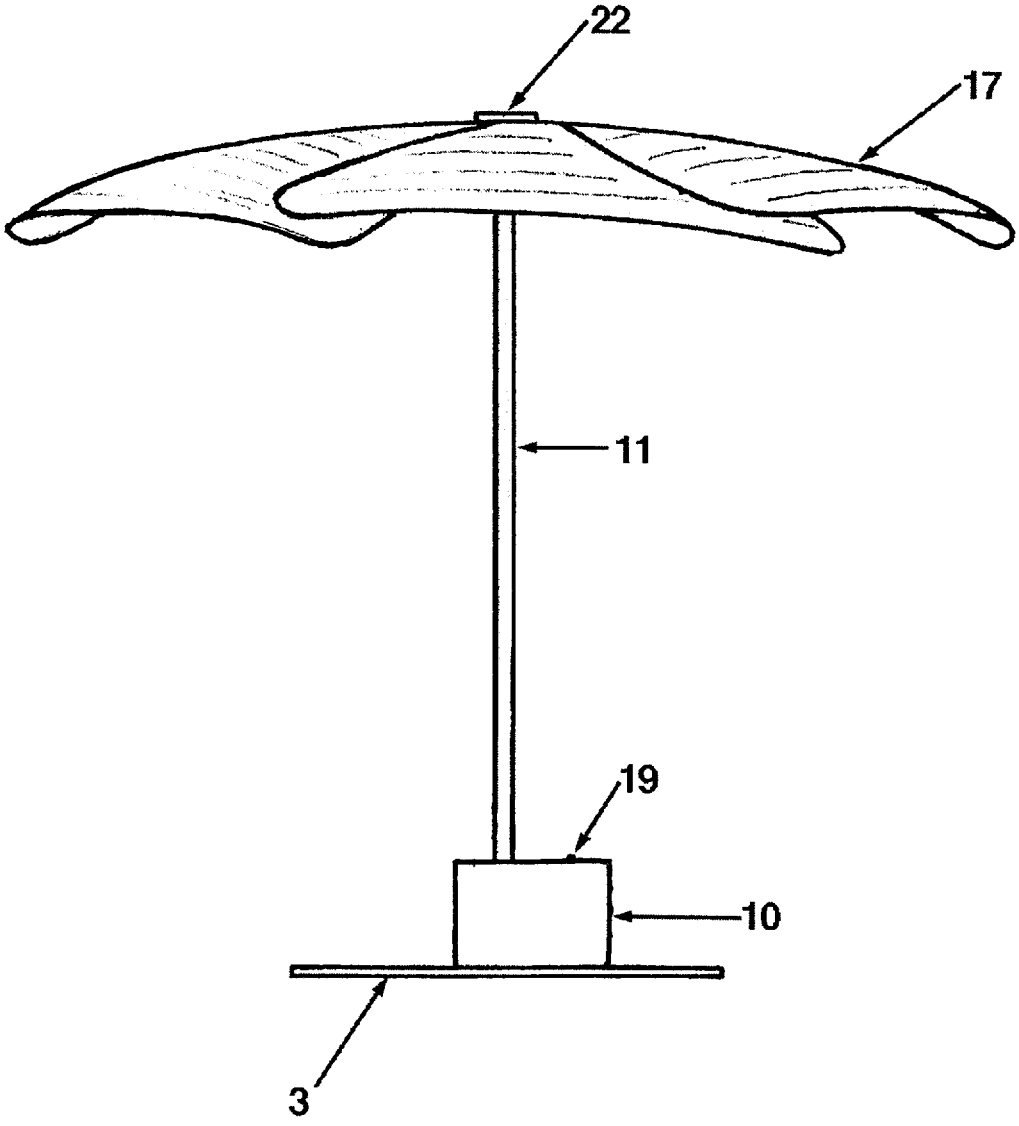
FIG. 4 is a side view of the present invention that shows the exterior components.

The petals 17 are shown in FIG. 3. These petals 17 radiate outward from the hub top 22. These petals 17 can be constructed as a single unit as in FIG. 3 or be comprised of a petal frame 37 and a petal covering 38 as in FIG. 5. This petal covering 38 can be comprised of any suitable fabric, material or polymer. In a preferred embodiment, solar panels 24 are attached to the petals 17 and provide power to operate the device.

Figure 5:
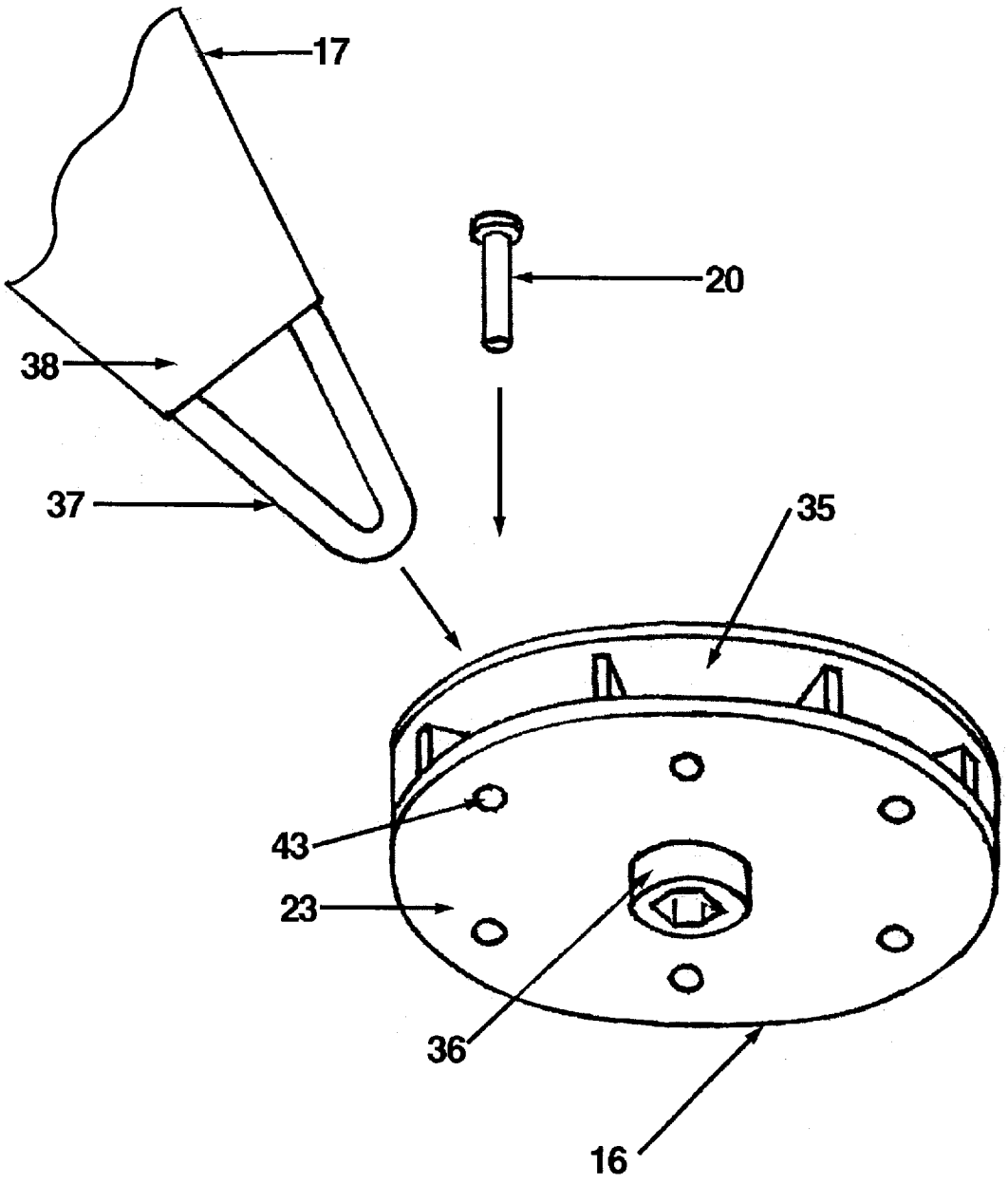
FIG. 5 is a close up of the hub showing how the petals fit into the hub pockets and are secured by an attachment pin.

FIG. 5 shows the hub 16 in detail. The petal frame 37 is inserted into a hub pocket 35. To attach the petal 17 to the hub 16, an attachment pin 20 is inserted through an attachment pin hole 43 passes through the petal frame 37 and out of the attachment pin hole 43 on the hub bottom 23. FIG. 5 also illustrates the hub connector 36 which acts as the insertion point for the distal end of the secondary shaft 26. The petal 17 in FIG. 5 is comprised of a petal frame 37 which is covered with any suitable fabric, material or polymer.

Figure 6:
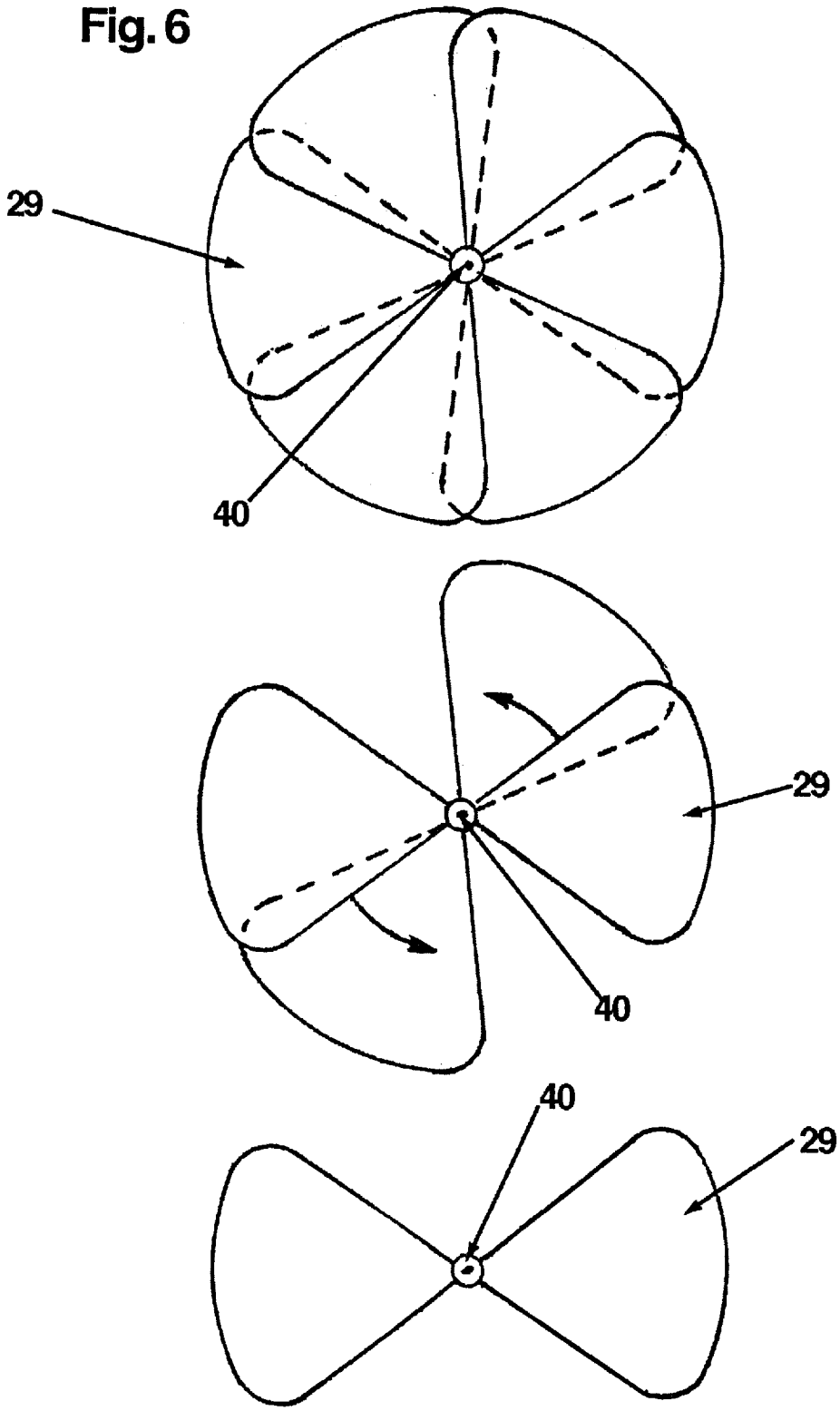
FIG. 6 shows a preferred embodiment wherein the petals are formed in biased stackable petal pairs which can be rotated about a stackable hub to further reduce wind loading or reduce the amount of storage area needed.
Figure 7:
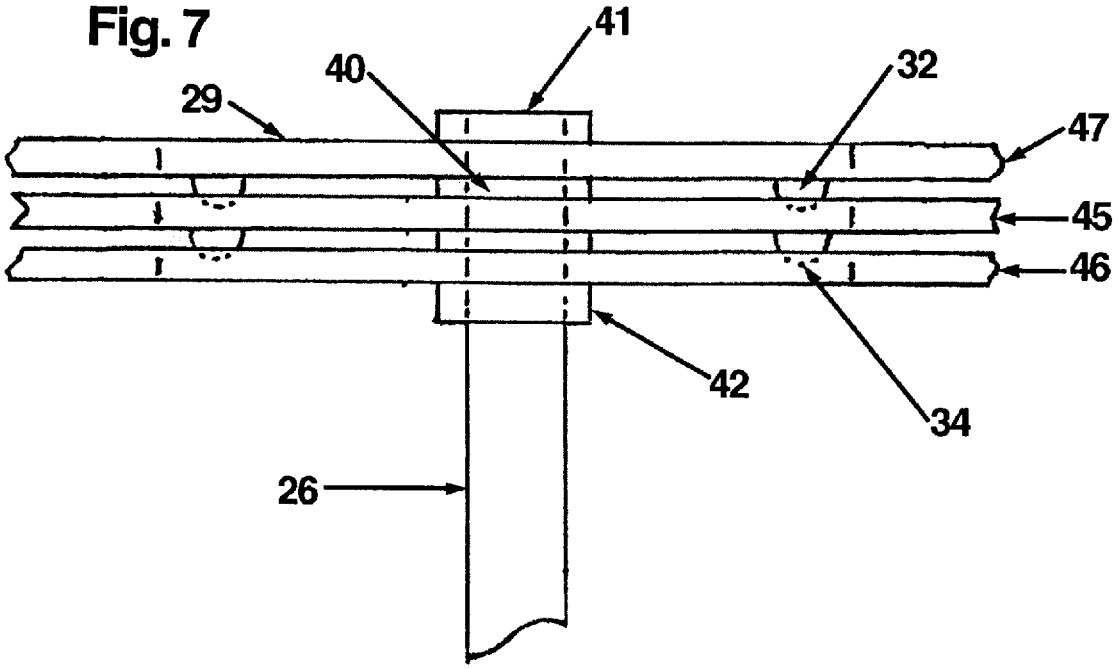
FIG. 7 illustrates a preferred embodiment wherein the biased stackable petal pairs are held by the stackable hub and are in stacked position with the detents connected to the detent insertion sites.

FIG. 6 shows a preferred embodiment that utilizes biased stackable petal pairs 29 rotating outward from the stackable hub 40 and illustrates how the biased stackable petal pairs 29 can be rotated around the stackable hub 40 to further reduce wind loading and provide for easier storage. FIG. 7 shows the stackable hub 40 in detail. This stackable hub 40 has a stackable hub top 41 which helps to secure the top biased stackable petal pair 44 in stacked position. The stackable hub 40 also has a stackable hub connector 42 which secures the distal end of the secondary shaft 26 to the stackable hub 40 and acts as a base for the bottom biased stackable petal pair 46. The top biased stackable petal pair 44 has detents 32 which protrude downwardly from the bottom of the top biased stackable petal pair 44. These detents 32 are inserted into the detent insertion sites 39 which are located on the top of the middle biased stackable petal pair 45 and act to secure the biased stackable petal pairs 29 in position. The middle biased stackable petal pair 45 also has detents 32 facing the bottom biased stackable petal pair 46 which fit into the detent insertion sites 39 of the bottom biased stackable petal pair 46.

Figure 8:
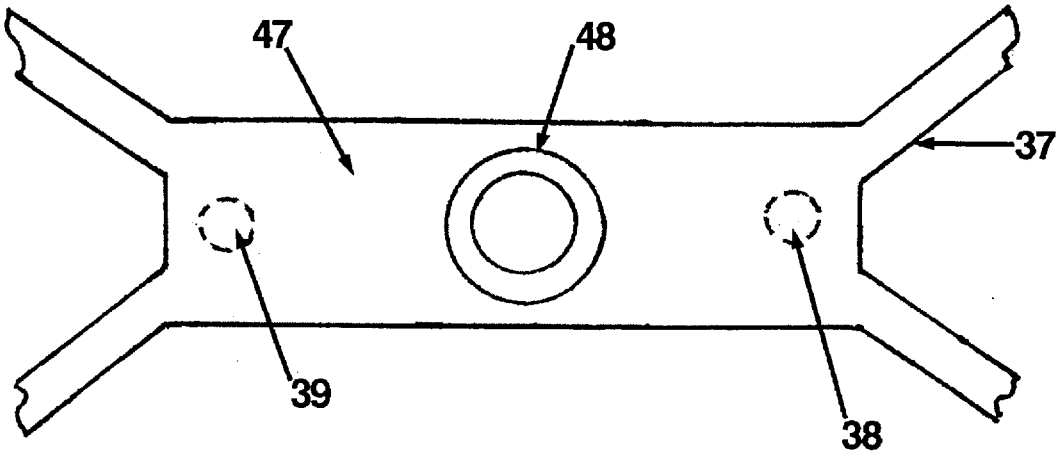
FIG. 8 is a close up of the center section of a biased stackable petal pair, called a biased stackable pair connector, showing the detent insertion sites, the top of the stackable hub, and the petal frame.

FIG. 8 shows a biased stackable petal pair connector 47 and where detents 32 would be located on the bottom of both the top biased stackable petal pair 44 and the middle biased stackable petal pair 45. This would also be the location of the detent insertion sites 39 on the top of the middle biased stackable petal pair 45 and the bottom biased stackable petal pair 46. There is a secondary shaft hole 48 located in the center of the biased stackable petal pair connector 47 where the secondary shaft 12 would be inserted. FIG. 8 also shows that the biased stackable petal pair connector is connected to the petal frame 37.

Figure 9:
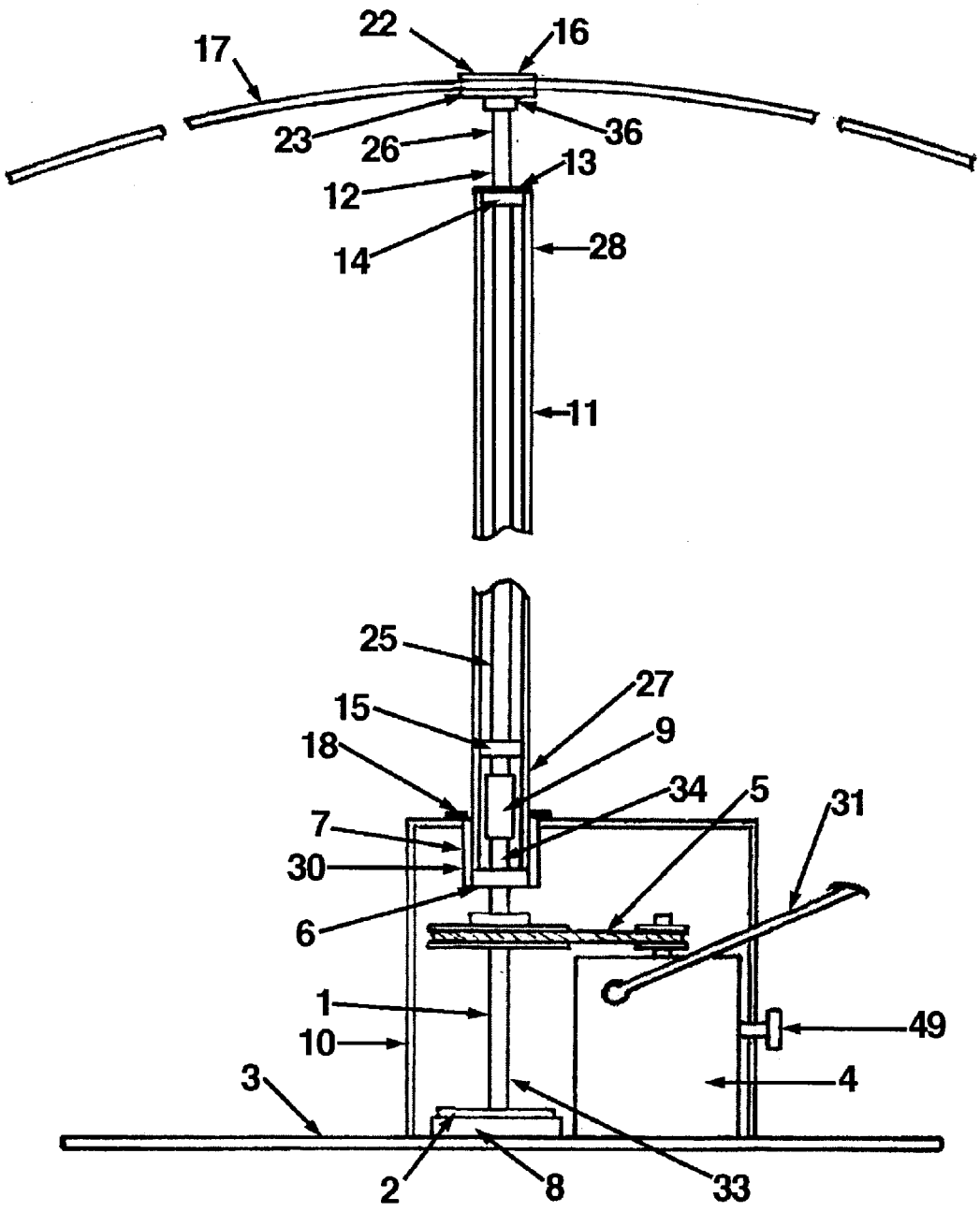
FIG. 9 is a preferred embodiment wherein the power to rotate the petals is supplied by a foot crank which can be used to "wind up" the drive shaft and rotate the petals.

Another preferred embodiment is shown in FIG. 9. In this preferred embodiment, the power to operate the device comes from a foot crank 31. This foot crank 31 can be pumped with a foot to "wind up" a mechanism to rotate the patio fan and umbrella 50. The rotation of the petals is activated by a speed control knob 49 which releases the stored up revolutions produced by the pumping of the foot crank 31 and can control the speed and direction of the rotating petals 17. The preferred embodiment of FIG. 9 does not utilize a motor 4, a variable speed control switch 19 or a ground fault interrupter duplex electrical outlet 21 since electricity is not being used to power the rotating patio fan and umbrella 50.

One of ordinary skill in the art will be able, after reading the foregoing specification, to effect other changes, alterations, and substitutions of equivalents without departing from the broad concepts disclosed. It is therefore intended that the scope of letters patent granted hereon be limited only by the definition contained in the appended claims and the equivalents thereof.

What is claimed is:

1. An umbrella served as a fan comprising:

a hub having a plurality of hub pockets, a top and a bottom;

a hub connector on said bottom of said hub;

a plurality of attachment pin holes extending through said hub;

a plurality of overlapping segmented petals extending outward radially from said hub pockets;

an attachment pin extending through said attachment pin holes securing said petals in said hub pockets;

a rotatable secondary shaft having a distal and a proximal end;

said distal end of said rotatable secondary shaft engaging said hub at said hub connector;

a drive shaft having both a proximal end and a distal end;

a thrust bearing securing said proximal end of said drive shaft;

a thrust bearing housing enclosing said thrust bearing;

a drive shaft bearing securing said distal end of said drive shaft;

a slide coupling connecting said proximal end of said rotatable secondary shaft to said distal end of said drive shaft;

a removable stationary shaft being hollow and having both a proximal and distal end;

a distal bearing at said distal end of said removable stationary shaft supporting said distal end of said rotatable secondary shaft;

a proximal bearing located above said slide coupling and providing support for said proximal end of said rotatable secondary shaft;

said removable stationary shaft enclosing said distal end of said drive shaft, said drive shaft bearing, said slide coupling, said distal bearing said proximal bearing, and at least ⅔ of said rotatable secondary shaft;

a smaller weather shield washer on top of said distal end of said removable stationary shaft;

a secondary shaft receiver supporting said proximal end of said rotatable secondary shaft;

a bearing housing;

a base plate;

a drive mechanism operatively attached to said drive shaft;

a motor attached to said base plate;

a main housing attached to said base plate and enclosing said motor, said thrust bearing, said drive shaft, said drive means, and continuous with said secondary shaft receiver;

a larger weather shield washer surrounding said secondary shaft receiver;

a ground fault interrupter duplex electrical outlet;

a base plate to which said motor and said main housing are attached; and a variable speed control switch to turn on said motor, powering said drive mechanism, rotating said drive shaft and said rotatable secondary shaft attached to said hub and rotating said petals in a fan like fashion.

2. An umbrella served as a fan as in claim 1 wherein the power is supplied through solar cells.

3. An umbrella served as a fan as in claim 1 wherein the petals are formed as pairs.

4. An umbrella served as a fan as in claim 1 wherein said petals are comprised of any solid material.

5. An umbrella served as a fan as in claim 1 wherein said drive shaft alternatively be driven in reverse.

6. An umbrella served as a fan as in claim 1 wherein said removable stationary shaft is comprised of PVC pipe;

said PVC pipe being rotatable unless friction is applied against it; and said proximal and said distal bearings are removed leaving said secondary shaft unobstructed.

7. An umbrella served as a fan as in claim 1 further comprising:

petals formed in at least 3 biased stackable petal pairs including one top biased stackable petal pair, at least one middle biased stackable petal pair and one lower biased stackable petal pair;

a biased stackable petal pair connector in the center of each said biased stackable petal pair;

a secondary shaft hole in the center of each said biased stackable petal pair connectors;

detents protruding downwardly from said top and middle biased stackable petal pairs;

detent insertion sites on said middle biased stackable petal pairs and said bottom biased stackable petal pairs;

a stackable hub having a stackable hub connector, a top and a bottom; and a secondary shaft connected to said stackable hub connector.

8. An umbrella served as a fan as in claim 1 further comprising:

a foot crank operatively attached to said drive mechanism; and a speed control knob.

* * * * *